US006866340B1

(12) United States Patent
Robertshaw

(10) Patent No.: US 6,866,340 B1
(45) Date of Patent: Mar. 15, 2005

(54) SPINAL GLIDE ERGONOMIC CHAIR SEAT AND PELVIC STABILIZER

(76) Inventor: Richard C. Robertshaw, 12263 Slate Creek Rd., Nevada City, CA (US) 95959

( * ) Notice: Subject to any disclaimer, the term of this patent is extended or adjusted under 35 U.S.C. 154(b) by 380 days.

(21) Appl. No.: 09/643,551

(22) Filed: Aug. 22, 2000

Related U.S. Application Data

(63) Continuation-in-part of application No. 09/223,869, filed on Dec. 31, 1998, now Pat. No. 6,139,095.

(51) Int. Cl.[7] ..... A47C 1/02
(52) U.S. Cl. ..... 297/312; 5/719; 297/314
(58) Field of Search ..... 297/284.2, 284.3, 297/312, 105, 344.21, 314; 5/719, 244, 655.9

(56) References Cited

U.S. PATENT DOCUMENTS

| | | | | | |
|---|---|---|---|---|---|
| 2,799,323 | A | * | 7/1957 | Berg | |
| 3,080,195 | A | * | 3/1963 | Berg | 297/312 |
| 3,263,247 | A | * | 8/1966 | Knittel et al. | 5/719 X |
| 3,280,410 | A | * | 10/1966 | Propst et al. | 297/452.49 X |
| 4,194,255 | A | * | 3/1980 | Poppe | 5/655.9 X |
| 4,429,427 | A | * | 2/1984 | Sklar | 5/655.9 X |
| 4,744,351 | A | * | 5/1988 | Grundei et al. | 5/462 X |
| 4,826,247 | A | * | 5/1989 | McGrady et al. | 297/314 |
| 4,840,425 | A | | 6/1989 | Noble | |
| 4,944,554 | A | | 7/1990 | Gross et al. | |
| 5,022,385 | A | | 6/1991 | Harza | |
| 5,022,708 | A | * | 6/1991 | Nordella et al. | |
| 5,024,485 | A | | 6/1991 | Berg et al. | |
| 5,288,127 | A | * | 2/1994 | Berg et al. | 297/312 |
| 5,314,238 | A | | 5/1994 | Komorowski et al. | |
| 5,402,545 | A | * | 4/1995 | Jolley | 5/653 |
| 5,426,799 | A | * | 6/1995 | Ottiger et al. | 5/476 |
| 5,580,128 | A | | 12/1996 | Johnson et al. | |
| 5,588,704 | A | | 12/1996 | Harza | |
| 5,662,376 | A | * | 9/1997 | Breuer et al. | 297/216.2 |
| 5,709,363 | A | | 1/1998 | Matsuhashi | |
| 5,735,573 | A | | 4/1998 | Vredevoogd | |
| 5,751,129 | A | | 5/1998 | Vergin | |
| 5,769,492 | A | * | 6/1998 | Jensen | |
| RE35,961 | E | * | 11/1998 | Wiebe | |
| 5,913,568 | A | | 6/1999 | Brightbill et al. | |
| 5,976,097 | A | * | 11/1999 | Jensen | 601/24 |
| 6,042,093 | A | * | 3/2000 | Garelick | 267/131 |
| 6,079,782 | A | * | 6/2000 | Berg et al. | 297/284.3 |

* cited by examiner

*Primary Examiner*—Peter M. Cuomo
*Assistant Examiner*—Stephen Vu
(74) *Attorney, Agent, or Firm*—Thomas M. Freiburger

(57) ABSTRACT

A chair and standing device includes a mechanism for allowing movement in an individual's hips and lower back while seated in a chair or standing in one's workstation, by letting the pelvis glide unabated through an apparatus made up of a series of balls, round springs or magnets built into a two pad chair seat cushion. Two pads under the respective ilia of the person preferably move in a forward & rearward glide pitch, roll, yaw and opposing medial glide enhanced by a ¼" to ⅜" raised platform in the center of the apparatus. The chair allows the pelvis to move in a gliding motion that mimics walking while the person is seated or standing, thus reducing the structurally caused lower back pain and stiffness so commonly associated with long periods of standing or sitting.

4 Claims, 6 Drawing Sheets

FIG. 1
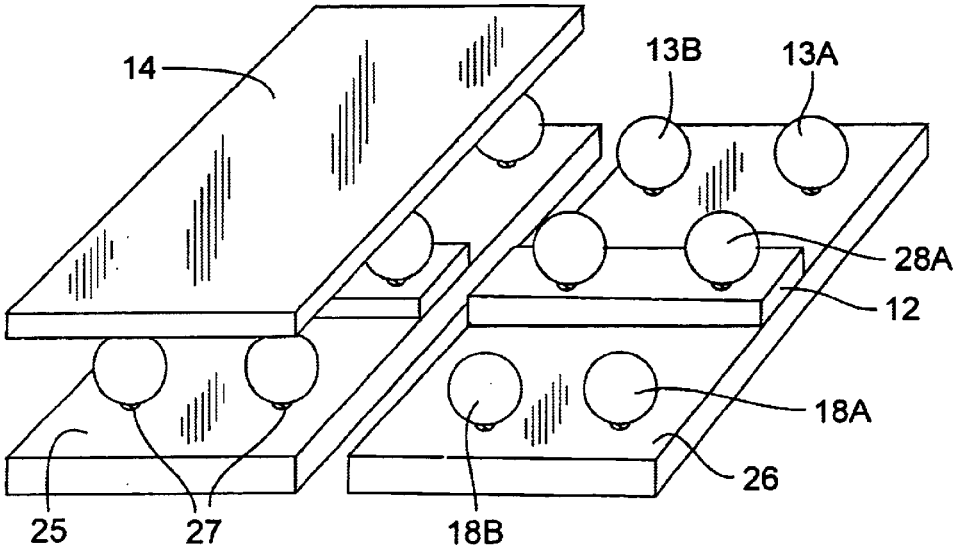
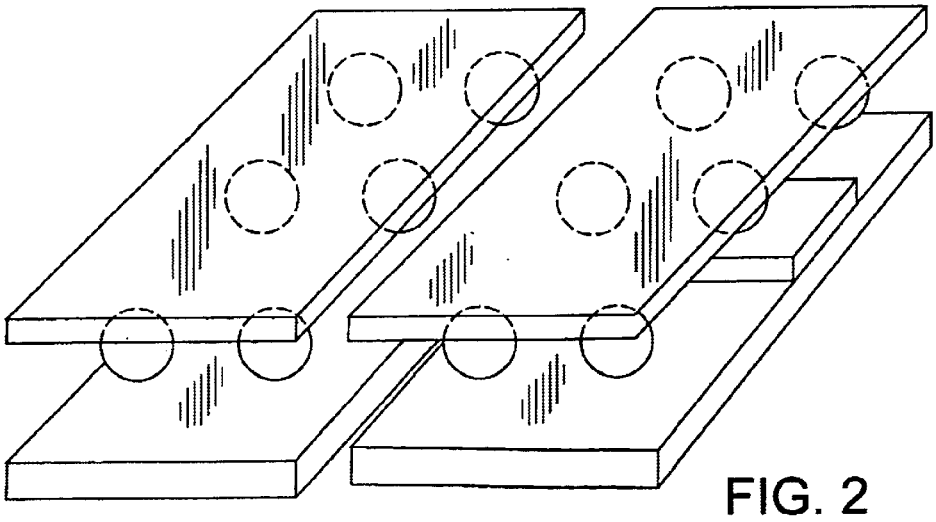
FIG. 2

SPINAL GLIDE ERGONOMIC CHAIR SEAT AND PELVIC STABILIZER

This application is a continuation-in-part of application Ser. No. 09/223,869 filed Dec. 31, 1998, now U.S. Pat. No. 6,139,095. In addition, the disclosure of Ser. No. 09/233,859 is incorporated herein by reference.

BACKGROUND OF THE INVENTION

The object of this invention is concerned with the seat portion of an ergonomic chair. The intention is to allow the pelvis to move in reciprocating gliding motion rather than forcing the pelvic bones to compress on a stationary cushion or seat, thus reducing postural instigated lower back pain.

Sitting in a standard chair seat, whether it is cushioned, metal, wood or plastic single piece chair seat, does not allow the three pelvic bones to move. Weight distribution on the pelvis is through the sits bones, known as the ischial tuberosities, and not the central sacral bone. The skeletal system of the human body is a functional, biomechanical structure moved by muscles and supported by ligaments. Skeletal bones are not only moved by muscles yet influenced by the rhythmic waves of circulation, digestion, lymph and cerebral spinal fluid flows. Therefore, the skeletal bones are constantly in motion. They allow other fluid systems to function by internally and externally rotating around the center axis of the body. Heart rate and peristalsis can be measured by listening to these systems through a sphygmomanometer listening device while the hydraulic cerebro-spinal fluid movement by the movement of the skeletal structures. This movement is dependent on the pitch (flexion-extension), roll (lateral flexion-extension and yaw (internal-external motion on a vertical axis) of the skeletal structures. The skull, spinal column and the sacral bone of the pelvis house the cerebro-spinal fluid system. There exists in this closed hydraulic a flow of cerebro-spinal fluid that is essential for neural activity.

The cerebro-spinal fluid originates in the in the ventricles in the center of the skull and travels through the lower back into the sacral reservoir. The movement of the pelvis when walking aids in the movement this fluid, along with with the assistance of the dural sheaths, back up the spine and into the skull. Any impediment of this fluid flow results in a stasis of cerebro-spinal fluid in the lower back. It is this loss of motion, stasis and accompanying neural root irritation that leads to muscle compression resulting in lower back pain and stiffness when one must sit or stand for long periods of time in or on a static seat. If a chair seat is to address this problem, the seat must support the two sides of the pelvic bones (ilia) independently and allow gliding movement to assist the normal range of motion of the pelvis and lower back.

All seats are motionless and do not allow pelvic motion to occur. Based on the premise that the structure of the pelvis influences the function of cerebro-spinal flow, it is important to maintain adequate motion of the three pelvic bones, the two iliac bones and the sacrum.

The intent of the Spinal Glide ergonomic chair seat is to enhance cerebrospinal fluid motion by allowing or enhancing the pelvic ilia to glide in movement while one is seated in the Spinal Glide seat or standing on the Spinal Glide standing apparatus. The seat and the standing apparatus are the same invention, it can be used for either sitting or standing, only the supporting structures are different.

Chairs with moving seat elements, which may be motorized or otherwise driven for the purpose of relieving fatigue and stimulating some of the hip motion of walking, have been known. Harza U.S. Pat. No. 5,588,704 shows a rocking platform incorporated in a seat, causing one hip to be lifted and then the other in a rhythmic manner while the person is seated. The disclosed apparatus also allows for forward and backward gliding movement of each hip. Harza U.S. Pat. No. 5,022,385 is directed at a similar goal, but using air bags and a pneumatic pump for vertically moving the two hips up and down in opposition.

Other patents which show power seat mechanisms, but not with the purpose of hip and pelvic motion, include U.S. Pat. Nos. 5,314,238, 5,709,363, 5,735,573 and 5,751,129. Specific patents pertaining to the motion of the pelvis are Brightbill et al. U.S. Pat. No. 5,913,568 addresses as stated only the vertical motion and rocking motion sufficient to allow pelvic motion from a horizontal plane, it differs from the disclosed apparatus because the Spinal Glide seat has a specifically raised central platform of ¼ to ½ inch. In order for the pelvis to adequately rock there most be a solid, raise platform to fulcrum over. With the raised platform with springs or rubber balls, there is not a rocking motion yet a forward and backward gliding motion of the seat. Not the rocking, and vertical motion cited by Brightbill et al. Yet where Brightbill limits the seat motion to vertical motion and horizontal rocking, the Spinal Glide seat includes rolling laterally, yawing motion to allow for twisting movement and also allows an opening of the ischial bones to alleviate pressure on the sacral bone when one is seated in an erect position.

It one is to address range of motion of the pelvis, they must consider a device that includes pitch, roll and yaw movement. Brightbill also consider pneumatics to be placed under there seats, yet Harza's patent originally included the alternating motion pneumatic motion. Spinal glide utilizes springs, rubber balls and like pole magnets to allow for the pitch, roll and yaw movement.

Berg's patent; Berg et al. U.S. Pat. No. 5,024,485 allows a rocking motion yet without a raised platform under the central movement. They also specifically state in column 2, line 64–66 that their movement addresses one horizontal plane by stating "only back and forth movement in a horizontal rocking motion as opposed to universal movement." Also, all of the patents mentioned do not include any standing position apparatus or recommendations which allow for pelvic motion in a standing position.

SUMMARY OF THE INVENTION

The Spinal Glide ergonomic chair seat and standing apparatus effectively enhances pelvic motion to occur when one is sitting or standing on the device by allowing the two iliac bones to move reciprocating range of motion on the two sided platform. This prevents back pain and stiffness by allowing the pelvis to move in a full pitch, roll and yaw motion as the person moves around on the seat or on the standing device. The chair seat of the invention does partially mimic walking. The object is to enhance the motion of walking when on is seated and allow the pelvis to move in it's subtle range of motion, so the sacrum does not fixate or become immobile. The sacrum is not a weight bearing joint as are the acetabular joints. Although the sacrum supports the spine, the weight of the spine is distributed forward on the sacrum, out through the thick ileo-lumbar ligaments of the 4th and 5th lumbar vertebra and into the two iliac bones of the pelvis.

The distribution of the weight of the spine and the torso allows the sacrum to perform its normal pitch, roll and yaw motion, which assists the cerebro-spinal fluid to continuously flow up and down the spine. The chair seat and standing apparatus influences the movement of the structures of the lower spine including the iliac bones, femurs, sacrum and lumbar spine, all of which contribute to the overall integrity of the lower back, and aids the spine's function of moving the body and supporting the individual in a seated as well as standing position. The movement of the sacrum is crucial for the health and functioning of the enclosed primary respiratory hydraulic fluid system that affects the entire spinal nervous system.

The primary function of the apparatus of the invention is not limited to allow reciprocal motion from one side to the other but to also enhance the forward and rearward motion, twisting and lateral roll in order to keep the sacral and pelvic bones from fixating disrupt the movement of cerebro-spinal fluid from the sacral reservoir to the skull. This movement is achieved by two individual seats, one each to support each side of the ilia.

Each of the two seats or platforms is supported by 9 rubber balls or 4 round springs. Three stationary bails in the front to support the front of the seat. Three in the middle which are raised on a platform ¼" to ½" in height. And three balls in the back to support the rear of the seat. The raised middle the balls or round springs to roll slightly to enhance the seats to move forward and back, roll side to side and allow twisting from left to right an right to left. The standing device is similarly fitted except that there are six springs on each side of each of the two seats. Two in the front, two in the center on the raised platform and two in the back, to provide more lateral support when one is standing.

While the person is sitting in this seat the springs only lightly cushion the gravitational pressure on the lower back but specifically allows the pelvis to pitch, roll and yaw. The springs are round and two inches in height. As the individual shifts around in the seat the two sides of the chair seat glides with the two sides of the ilia (buttocks). If the seated individual turn to the left, the front of the right seat is forced forward as the left side glides back. This is the way the hips and legs move when shifting in the same direction. If the seated person moves forward to reach with the right arm, the right side of the chair seat will also glide forward while the left side is forced back. This is achieved by the persons weight shifting around on the seat. If the person leans to the right the lateral side of the right seat shifts down while the medial side shifts up and the left side moves in the same pattern, the medial side down and the lateral side up. If the person twists to the right of left the upper seats twist and glides forward and back. The same motion occurs even when the person is standing on the standing apparatus.

It is thus among the objects of the invention to provide a chair, seat or platform which allows an individual to sit or stand for long periods, whether driving, working behind a desk or engaging in other seated activities or standing behind a counter as a clerk or bank teller or in a factory, without irritating the lower spinal disks and pelvis. The device when built into the seat of chair or into the floor behind a workstation to help reduce the degree of strain and discomfort that results from long hours in a single seat chair or standing for long hours on a hard floor.

People move, when we sit or stand for long periods of time we fidget, shift from one side to another, move around, just to get the pelvis moving. That is why we eventually get up and walk around. We feel better when we are moving again. This seat is designed to let the body move around when we are sitting or standing in one place. These and other objects, advantages and features of the invention will be apparent from the following description of a preferred embodiment, considered along with the accompanying drawings. Previously designed chairs that have a split seat mechanism on address the rocking motion of the seat on a longitudinal basis and rocking motion from a neutral angle with an added vertical motion. None of them address the forward and rearward pitch, forward and rearward glide, twisting or yaw glide, lateral flexion-extension glide and medial outward glide. These five movement allow complete range of motion of the pelvis.

DESCRIPTION OF THE DRAWINGS

FIG. 1 is a perspective of the chair and standing device according to the invention, incorporating a mechanism that allows the pelvis to glide through it's range of motion while a person is seated or standing. The FIG. 1 drawing has the right side of the cushion missing to show how the balls are arranged under the seat.

FIG. 2 shows how the device looks with the right seat added. This is a view from the front oblique looking down at the seat.

DESCRIPTION OF PREFERRED EMBODIMENTS

Figure 3:
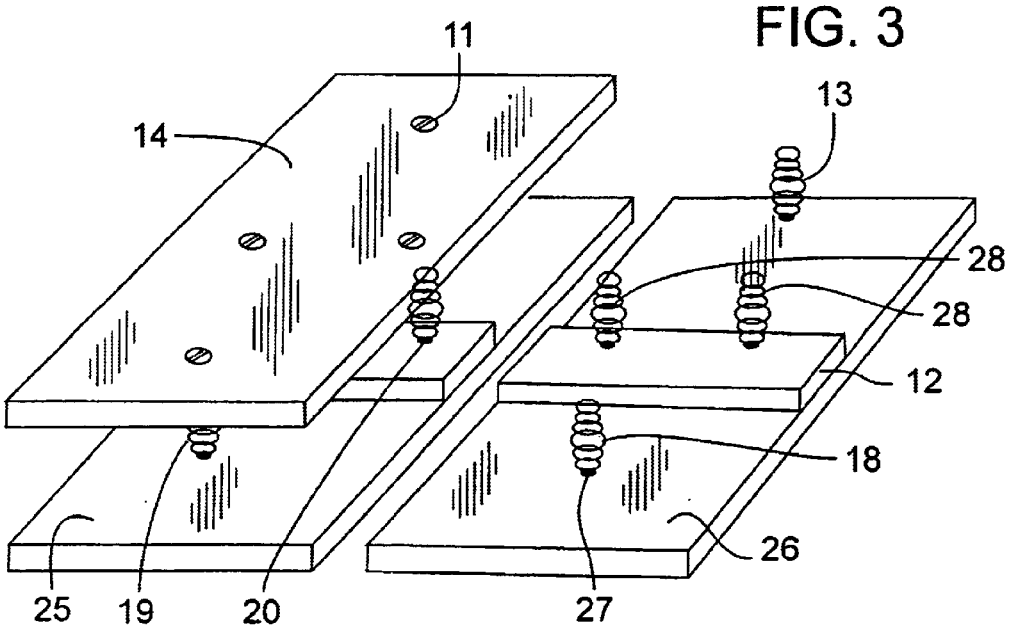
FIG. 3 is the same device with round springs instead of rubber or plastic bails with the right side of the seat cushion removed.
Figure 4:
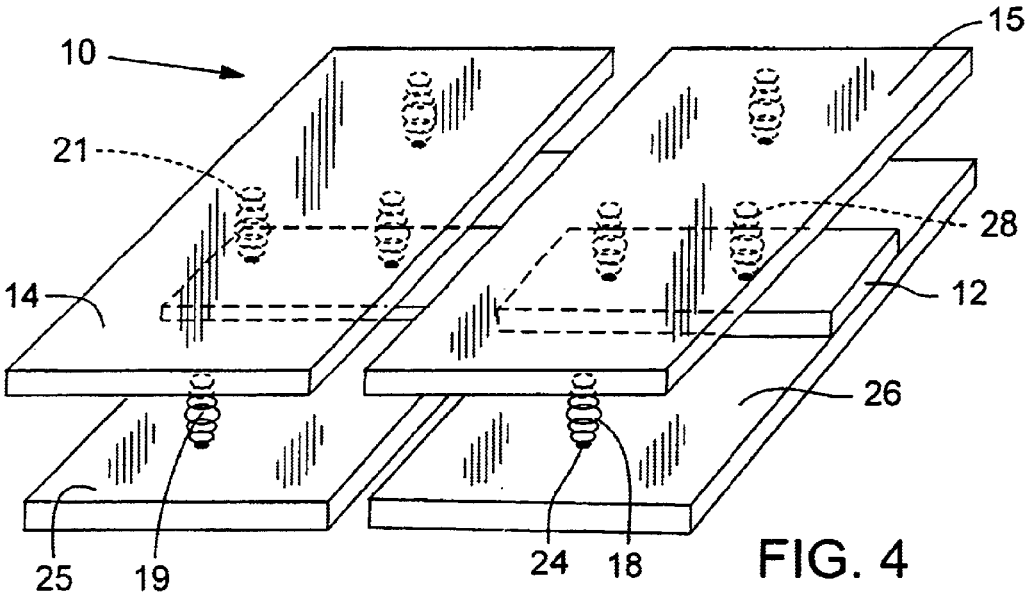
FIG. 4 shows the same device with the seat added.
Figure 5:
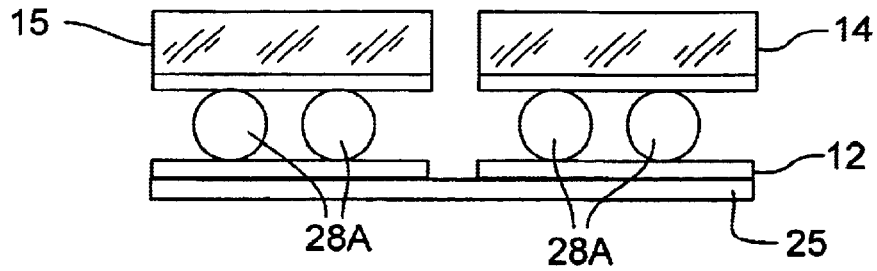
FIG. 5. is a front view with the seat in a neutral position with no weight bearing load on the seats.
Figure 6:
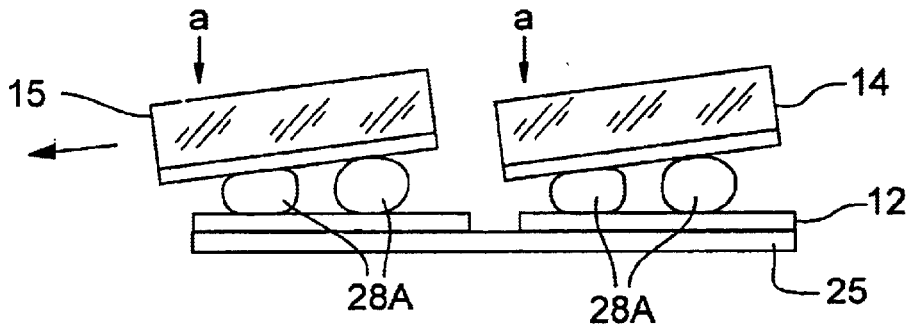
FIG. 6 is a front view with (a) representing the weight bearing load while the person sitting on the seat and leaning to the left. The seat glides down to the left with the set actually over hanging the seat base.
Figure 7:
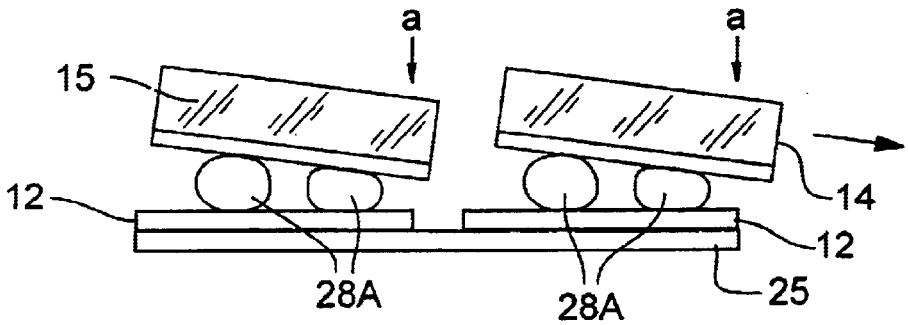
FIG. 7 same seat, front view with weight bearing (a) with the individual leaning to the right. The chair seat glides to the right and again over hangs the seat base.
Figure 8:
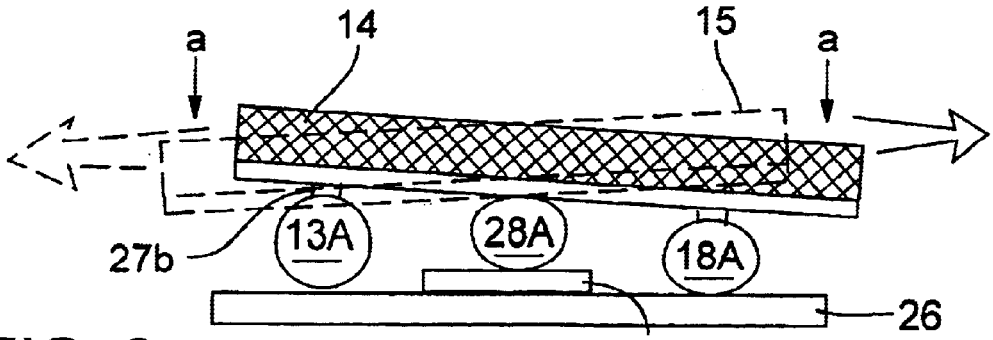
FIG. 8 reveals a side view of the seat. Weight bearing load as the person in the seat leans forward or twists to the right. The front balls squash slightly and rolls to allow the seat to move forward and actually over hangs the front of the seat base or back if the weight bearing is posterior when the person leans back, again over hanging the posterior seat base. If the individual twists to the left the right side of the chair seat yaws left and glides forward while the left side yaws left and the left seat glides posterior.
Figure 9:
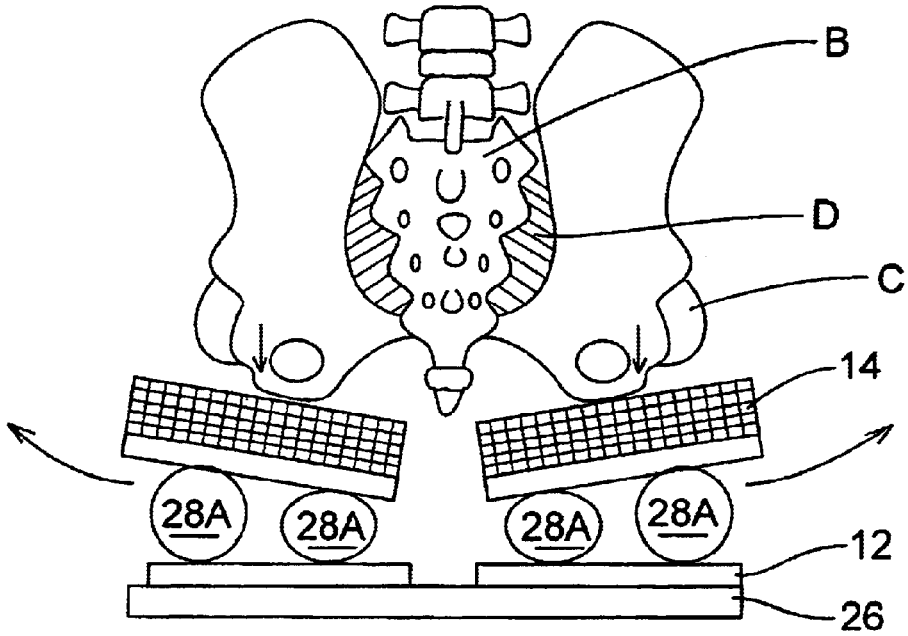
FIG. 9 is a posterior view of the chair seat showing the (a) weight bearing load forcing the lateral portion of the seat gliding laterally when the person is seated straight up. The lateral portion of the seat cushion also over hangs the seat base. The sacrum B has no weight bearing pressure on it while the seat allows the pelvic bones C to move laterally stretching the sacroiliac joint ligaments which is what occurs when a person is walking.
Figure 10:
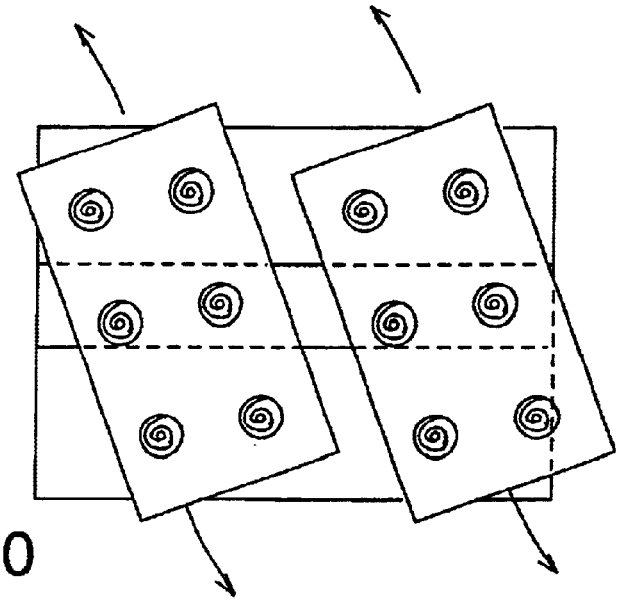
FIG. 10 shows an overhead view of the of the seat twisting (yawing) when the person seated in the chair turns or twists to the left.
Figure 11:
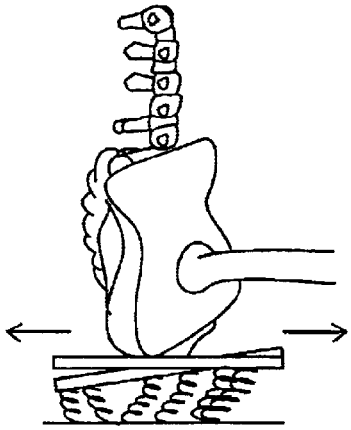
FIG. 11. reveals a skeletal view of the seat with weight bearing showing the forward glide.
Figure 12:
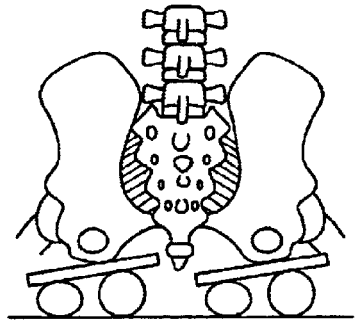
FIG. 12. show the seat in its lateral glide when the person bends to the left.
Figure 13:
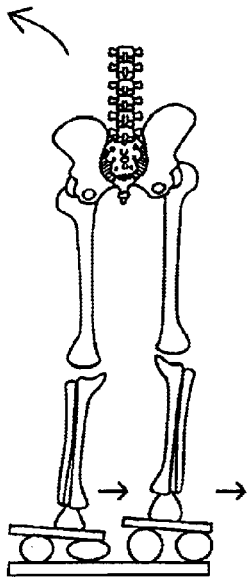
FIG. 13. shows the standing device when the person leans to the left.
Figure 14:
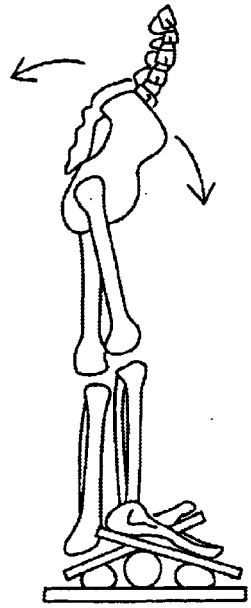
FIG. 14. shows the gliding of the standing device when the person leans forward or back.
Figure 15:
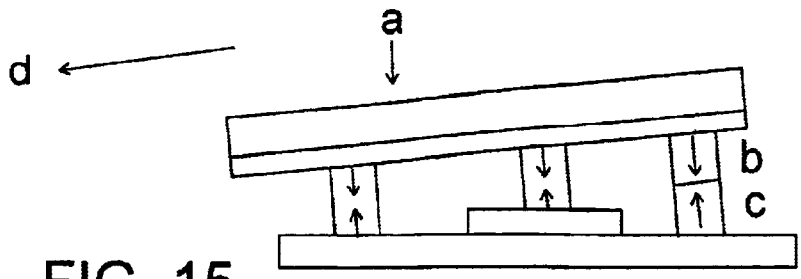
FIG. 15. shows the repellent forces of like magnetic polls (b) and (c) when a weight bearing force (a) is applied to the seat when a person leans forward with the forward glide to the left (d).
Figure 16:
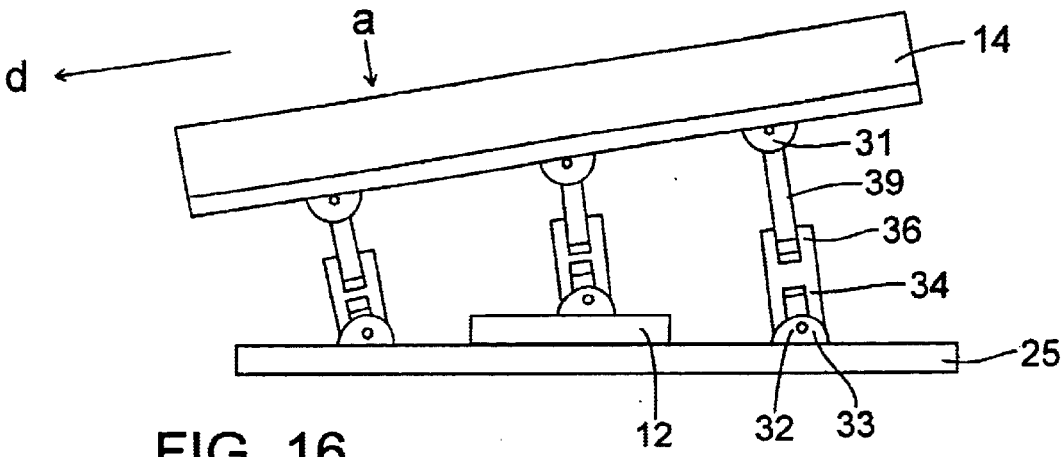
FIG. 16. is the same situation only with the cylinders containing the magnets in the magnetic gliding assembly.
Figure 17:
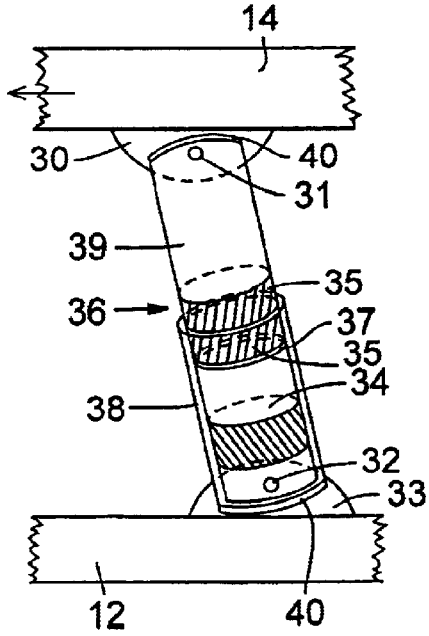
FIG. 17. The like poll magnetic gliding assembly. Support 30 is connected to the underside of one of the seats 14. The support 30 houses a pivot pin 31 the bores through the upper end of a cylinder shaft 39 which houses on it's lower end the north pole of a strong magnet 35, north pole down. The upper cylinder shaft fits into a lower cylinder shaft 38. The lower cylinder shaft is connected at the lower end by a pivot pin 32 supported by support brace 33. The bottom of the lower cylinder 38 houses a strong north pole magnet 34, is connected to the base of the seat 12. As the weight bearing pressure forces the top of the seat down the like poles inside the cylinder are pushed together. Yet with nine strong magnets under each of the two seats, (three in the front section, three in the center on the raised platform and three in the back portion) the opposing magnetic like forces keep the upper portion of the seat from contacting the lower portion, while the pivot pins allow an extremely smooth forward and rearward gliding motion of the two sides of the chair seats.

The ergonomic chair seat and standing device of the invention is a movable two sided seat that allows the reciprocal gliding of the two iliac bones of the pelvis. FIG. 1 shows the chair with one cushion 15 removed revealing the under rubber or plastic balls 13 A &B, 16, 17 and 18 A & B with balls 28 A & B and 29 on a ¼" or ⅜" platform 12 made of plywood or plastic. Each of the balls is attached to the base portion 25 and 26 by glue 27 or in the case of round springs by a bolt, FIG. 3 #27. The base of the chair 26 & 27 can be made of plastic, plywood, or aluminum. In FIGS. 1 and 2 the balls are attached to the under surface of the upper seat by glue on the platform and by glue and a ¼ to ½ plastic spacer or foam, 27*b,* to balance out the raised platform and allow the seat to glide.

FIG. 3. shows the same chair seat with round springs. The springs are round, not typical straight coils springs as seen in other chairs, the round spring provide a roll of the assembly. Enough so that the top of the chair seat will glide beyond the base of the seat, to provide the fullest range of motion of the pelvis. Round springs 13 & 22 are forward while 27 &19 are in the rear of the seat. Round springs 28 and 21 are raised platform to provide the most glide possible. The round springs are attached to the base of the seat by bolts 24 & 27 and to the seat itself by bolts 11. The roundness of the spring allows full gliding in all directions of pitch, roll and yaw, medial outward and well as forward and rearward glide.

The above described preferred embodiments are intended to illustrate the principles of the invention, but not to limit its scope. Other embodiments and variations to this preferred embodiment will be apparent to those skilled in the art and may be made without departing from the spirit and scope of the invention as defined in the following claims.

I claim:

1. A chair seat and standing apparatus for helping relieve and diminish lower back pain and stiffness while seated in a chair or standing on the apparatus, comprising:

a pair of pads including a left pad and a right pad, the two pads being positioned for supporting the respective pelvic ilia of a seated person, the pads including seat platforms at bottom sides, and including only two such seat platforms, one with each of the left and right pads, a lower platform in spaced relationship below the seat platforms, and resilient means positioned below and connected independently to each of said seat platforms and secured to the lower platform for allowing movement of the pelvis and lower back of the seated person via resilient springing action allowing the hip and pelvis motion of walking, and said resilient means defining and allowing for movement in pitch, roll and yaw as well as forward and rearward glide of the ilia and sacral bones relative to one another.

2. The apparatus of claim 1, wherein the resilient means include four resilient units below each of said seat platforms, arranged in spaced apart relationship, so as to allow said movement in pitch, roll and yaw as well as forward and rearward glide of the ilia and sacral bones relative to one another.

3. A chair seat apparatus for helping relieve and diminish lower back pain and stiffness while seated on the apparatus, comprising:

a pair of pads including a left pad and a right pad, the two pads being positioned to support the respective pelvic ilia of a seated person, the pads including seat platforms at bottom sides, left and right pads, a lower platform below the seat platforms, and resilient support means for supporting the two pads independently to thereby support the two pelvic ilia of the seated person independently and for defining movement that allows the ilia to move reciprocally relatively to one another in pitch, roll and yaw motion as well as forward and rearward glide and lateral glide of the ilia and sacral bones relative to one another.

4. The apparatus of claim 3, wherein the resilient means include four resilient units below each of said seat platforms, arranged in spaced apart relationship, so as to allow said reciprocal movement in pitch, roll and yaw as well as forward and rearward glide and lateral glide of the ilia and sacral bones relative to one another.

* * * * *